US009578977B2

(12) United States Patent
Smith

(10) Patent No.: US 9,578,977 B2
(45) Date of Patent: Feb. 28, 2017

(54) INTEGRATED DRAIN SYSTEM FROM A REFRIGERATED DISPLAY CASE

(71) Applicant: Heatcraft Refrigeration Products LLC, Richardson, TX (US)

(72) Inventor: Michael Smith, Phenix City, AL (US)

(73) Assignee: Heatcraft Refrigeration Products LLC, Richardson, TX (US)

( * ) Notice: Subject to any disclaimer, the term of this patent is extended or adjusted under 35 U.S.C. 154(b) by 15 days.

(21) Appl. No.: 14/474,337

(22) Filed: Sep. 2, 2014

(65) Prior Publication Data

US 2016/0058030 A1 Mar. 3, 2016

(51) Int. Cl.
*D06F 39/08* (2006.01)
*A47F 3/04* (2006.01)
*F25D 21/14* (2006.01)

(52) U.S. Cl.
CPC ..... *A47F 3/0482* (2013.01); *F25D 21/14* (2013.01)

(58) Field of Classification Search
CPC .. F28F 17/005; Y10T 137/5762; A47F 3/0452
USPC ..... 4/679, 681, 671–674; 137/312; 222/111; 220/592.04
See application file for complete search history.

(56) References Cited

U.S. PATENT DOCUMENTS 2,153,373 A * 4/1939 Ingalls ..... F25D 3/04 137/247.33
3,304,740 A * 2/1967 Balk ..... A47F 3/0447 62/256
3,397,714 A * 8/1968 Liljendahl ..... E03C 1/22 137/247.15
3,651,826 A * 3/1972 Kojima ..... E03F 5/0407 137/247.35
4,312,190 A * 1/1982 Ibrahim ..... F25D 21/06 62/156
2006/0265804 A1* 11/2006 Santa Ana ..... E03C 1/284 4/679
2014/0144521 A1* 5/2014 Bianchi ..... A47L 15/421 137/312

* cited by examiner

*Primary Examiner* — Shawn M Braden
(74) *Attorney, Agent, or Firm* — Hubbard Johnston, PLLC

(57) ABSTRACT

The present application provides a refrigerated display case. The refrigerated display case may include a tub assembly and a drain system in communication with the tub assembly. The drain system may include an integrated tee joint-drain trap.

12 Claims, 5 Drawing Sheets

INTEGRATED DRAIN SYSTEM FROM A REFRIGERATED DISPLAY CASE

TECHNICAL FIELD

The present application and the resultant patent relate generally to modular refrigeration systems and more particularly relate to a refrigerated display case and the like with an integrated drain system combining a tee joint and a drain trap for a reduced footprint without limiting overall flow capacity.

BACKGROUND OF THE INVENTION

A modern supermarket may have any number of refrigerated display cases to store and display different types of frozen and refrigerated products. Many different types of refrigerated display cases may be used, including multi-deck coolers, reach-in coolers, and the like. Refrigerated display cases generally are modular in nature such that any number of individual units may be combined to create a display case of any suitable size or length.

Current designs for refrigerated display cases generally seek to maximize the usable refrigerated display space so as to contain as many products therein as possible. As a result, the remaining space for the refrigeration components and the like tends to be as small as possible. One result is that certain refrigerated display cases can no longer be drained out of the bottom and instead must use a drain line along the front of the case. Such an orientation, however, may create issues such as an intrusion into the customer area given the limited space.

There is thus a desire for an improved refrigerated display case. Such a refrigerated display case may minimize the space required for appropriate drainage without reducing the overall flow capacity. The refrigerated display case may provide such a reduced footprint with a reduction in the number of components for ease of installation. Moreover, the refrigerated display case may provide ease of access for cleaning and maintenance.

SUMMARY OF THE INVENTION

The present application and the resultant patent thus provide a refrigerated display case. The refrigerated display case may include a tub assembly and a drain system in communication with the tub assembly. The drain system may include an integrated tee joint-drain trap.

The present application and the resultant patent further provide a method of operating a refrigerated display case. The method may include the steps of positioning an integrated tee joint-drain trap along a front of the refrigerated display case, flowing condensate from a tub assembly to the integrated tee joint-drain trap, removing a drain plug from the integrated tee joint-drain trap, and cleaning the integrated tee joint-drain trap.

The present application and the resultant patent further provide an integrated tee joint-drain trap positioned along a front of a refrigerated display case. The integrated tee joint-drain trap may include a tee joint portion, a drain trap portion integral with the tee joint portion, and a drain access port.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
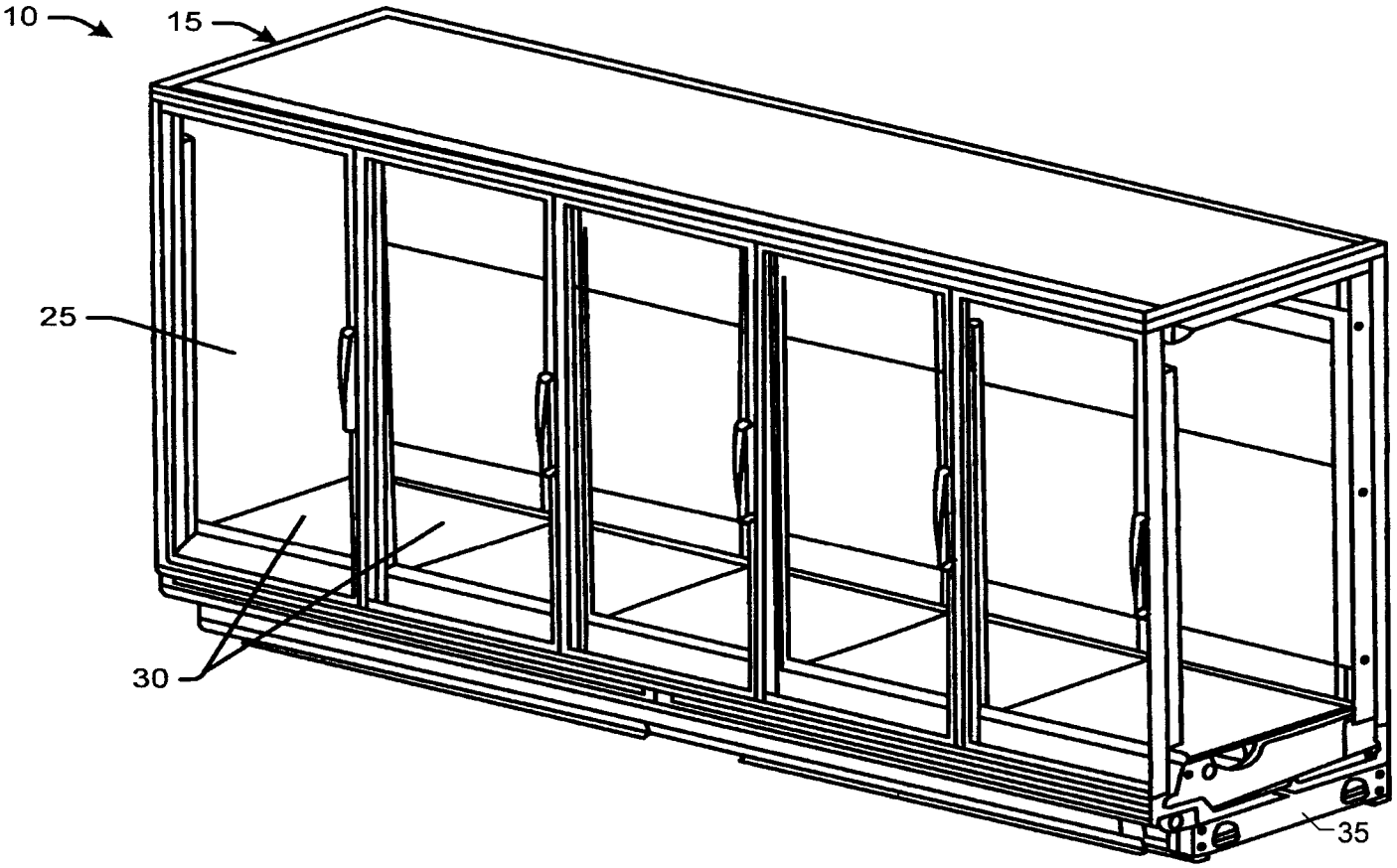
FIG. 1 is a perspective view of a known refrigerated display case in the form of a reach-in cooler.
Figure 2:
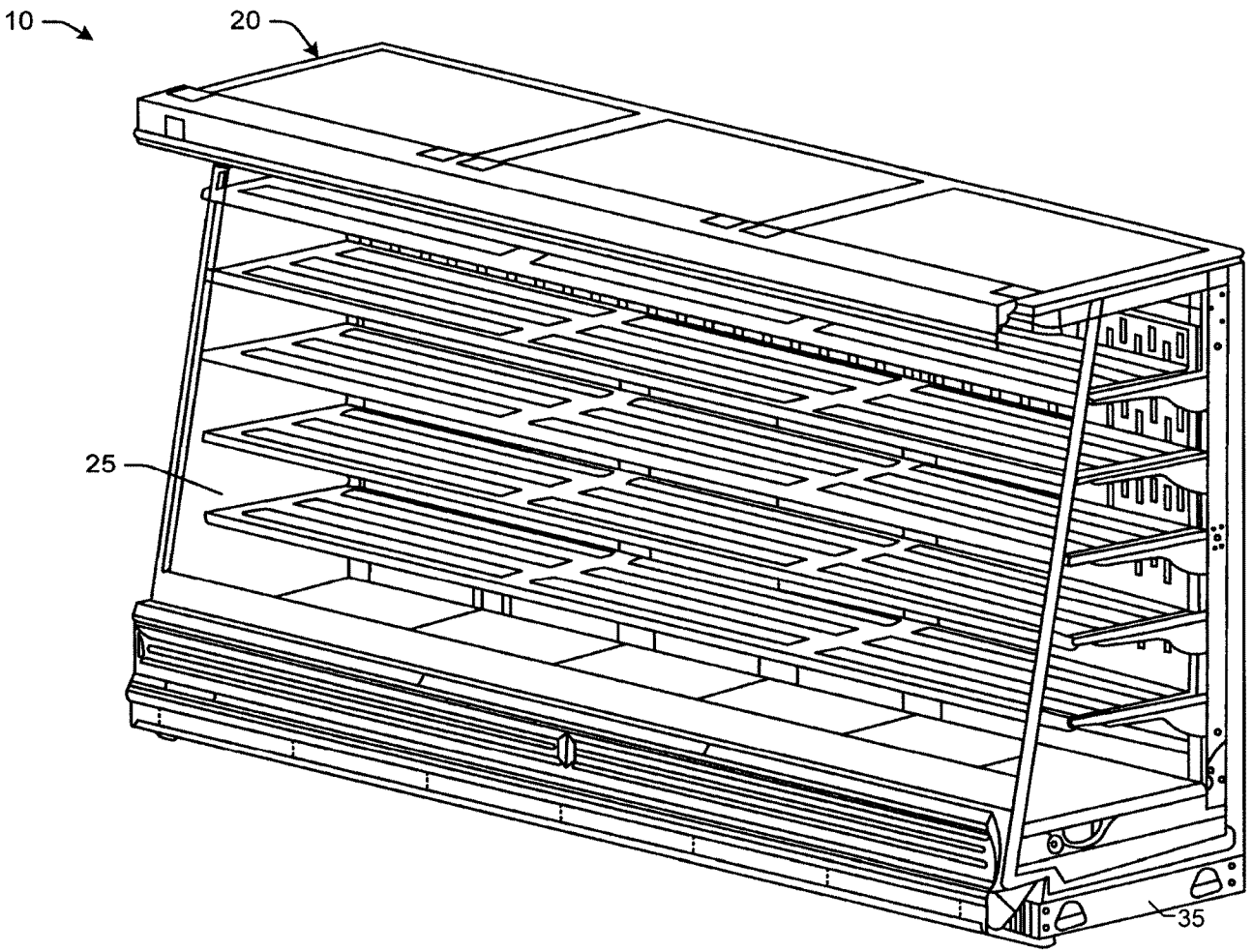
FIG. 2 is a perspective view of a known refrigerated display case in the form of a multi-deck cooler.

Referring now to the drawings, in which like numerals refer to like elements throughout the several views, FIG. 1 shows an example of a refrigerated display case 10. In this example, the refrigerated display case 10 may be in the form of a reach-in cooler 15. FIG. 2 shows an example of the refrigerated display case 10 in the form of a multi-deck cooler 20. In both examples, the refrigerated display case 10 may be substantially modular and may extend to any suitable length. The refrigerated display case 10 may define a refrigerated space 25. Any type or number of refrigerated or frozen products may be positioned within the refrigerated space 25. The refrigerated display case 10, and the component thereof, may have any suitable size, shape, or configuration. Other types of refrigerated display cases 10 may be used.

In the case of the reach-in cooler 15, the refrigerated display case 10 also may include a number of door panels 30. The door panels 30 may have any suitable size, shape, or configuration. The door panels 30 may be transparent in whole or in part. In the case of the multi-deck cooler 20, the refrigerated display case 10 may be largely open to the consumer given the use of an air curtain along the front thereof.

The refrigerated display case 10 may include a tub assembly 35. The tub assembly 35 may include a refrigeration unit therein. Any type of refrigeration unit and refrigeration components may be used herein. The refrigeration components may drain into a drain system. As described above, the drain system may extend along the front of the refrigerated display case. The drain system may include a tee joint leading to a drain line and with one or more drain traps positioned thereon. The drain traps function as a seal to prevent the passage of vapors and the like. The components of the drain system generally may be made from polyvinyl chloride ("PVC") and the like. The refrigerated display case 10 and the components thereof, are described herein for the purposes of example only. Many other and different refrigerated display case designs and configurations may be used.

Figure 3:
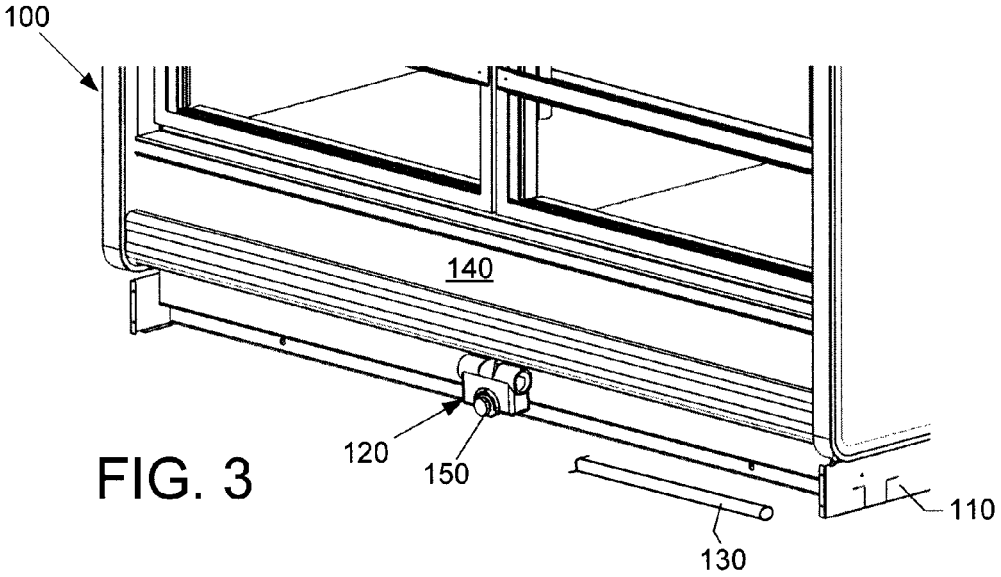
FIG. 3 is a perspective view of a portion of a refrigerated display case with an integrated drain system as may be described herein.
Figure 4:
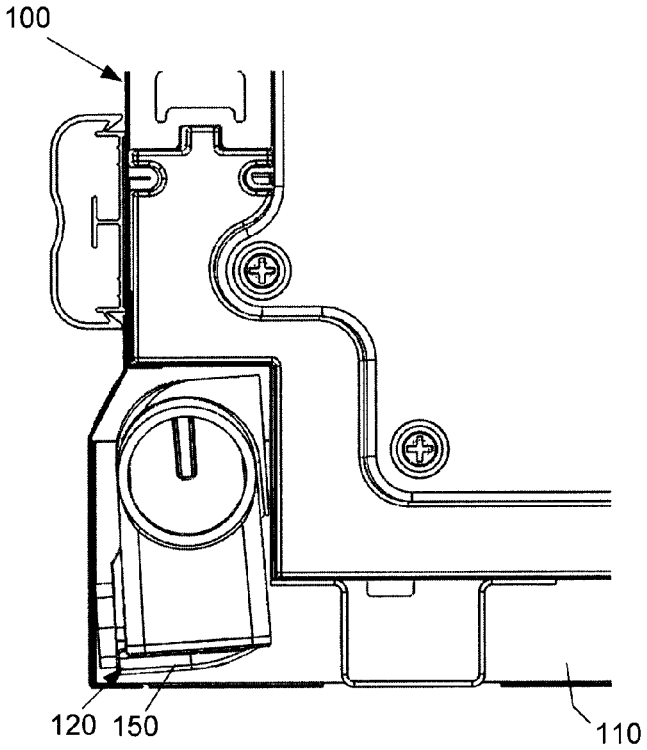
FIG. 4 is a side sectional view of the refrigerated display case with the integrated drain system of FIG. 3.
Figure 5:
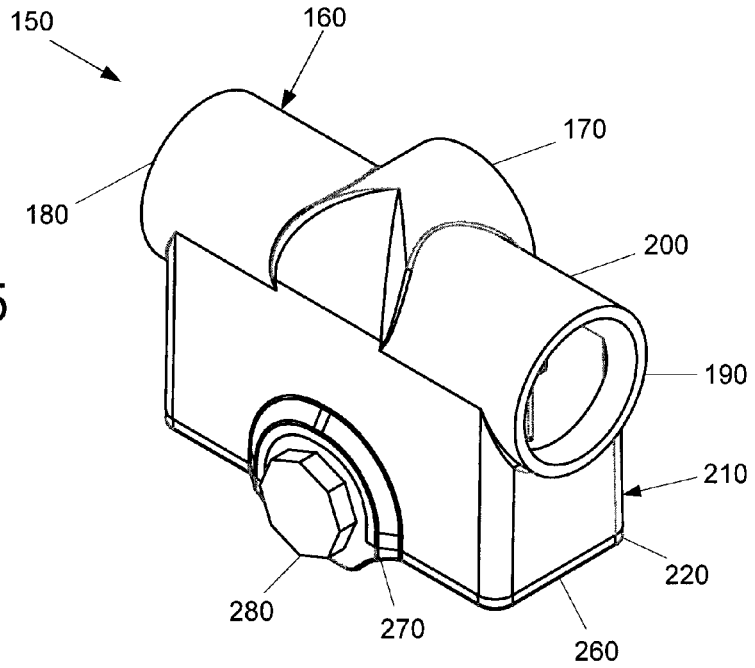
FIG. 5 is a perspective view of an integrated tee joint-drain trap of the integrated drain system of FIG. 3.
Figure 6:
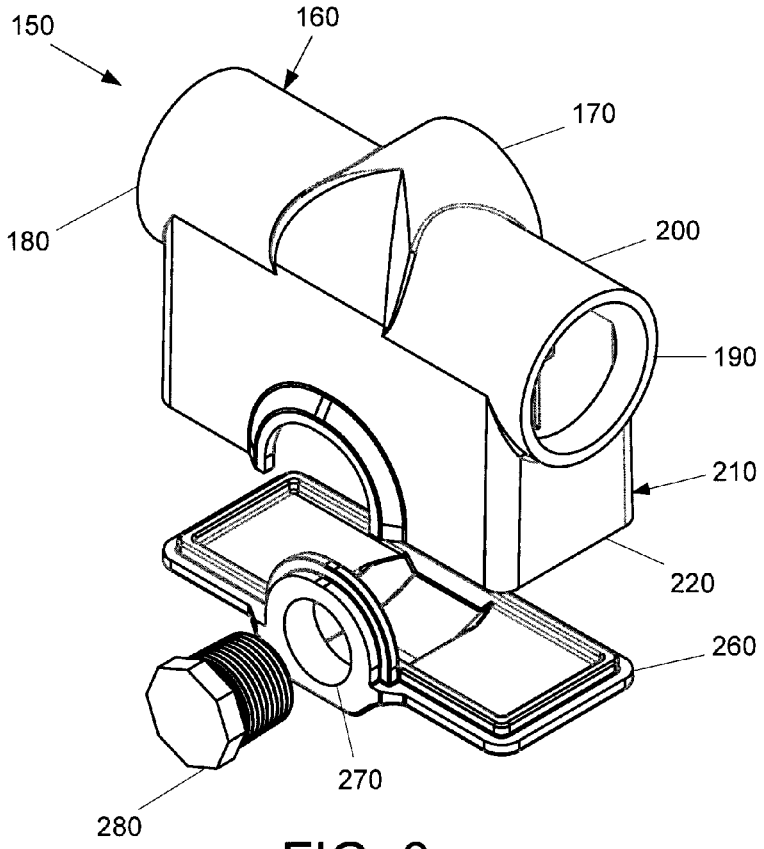
FIG. 6 is an exploded view of the components of the integrated tee joint-drain trap of FIG. 5.

FIGS. 3 and 4 show a refrigerated display case 100 as may be described herein. The refrigerated display case 100, and the components thereof, may have any suitable size, shape, or configuration. Similar to that described above, the refrigerated display case 100 may include a tub assembly 110. The tub assembly 110 may include any type of refrigeration components therein. The refrigeration components may drain into a drain system 120. The drain system 120 may include one or more drain lines 130. The drain lines 130 may have any suitable size, shape, or configuration. The drain lines 130 may extend along a front 140 of the refrigerated display case 100. The drain lines 130 may be connected to a conventional drain or other type of fluid collection system. Other components and other configurations may be used herein.

The drain system 120 also may include an integrated tee joint-drain trap 150. The integrated tee joint-drain trap 150 may be made from polyvinyl chloride or other types of substantially rigid materials. The integrated tee joint-drain trap 150 may include a tee joint portion 160. The tee joint portion 160 may have any suitable size, shape, or configuration. The tee joint portion 160 may include an inlet 170. The inlet 170 may be in communication with a flow of water such as a flow of condensate or other fluids from the refrigeration components of the tub assembly 110 or elsewhere. Although the inlet 170 is shown being substantially perpendicular to the tee joint portion 160, the inlet 170 may extend from vertical to horizontal or at any angle. The inlet 170 may have a flow divider 175 positioned therein. The inlet 170 of the tee joint portion 160 may intersect a first outlet 180 on one side thereof and a second outlet 190 on the other side thereof. The flow divider 175 may direct an incoming flow to either the first outlet 180 and/or the second outlet 190. The outlets 180, 190 may be in communication with the drain lines 130. The inlets 170 and the outlets 180, 190 of the tee joint portion 160 may form a substantial T-like shape 200. Other components and other configurations may be used herein.

The integrated tee joint-drain trap 150 also includes a drain trap portion 210. The drain trap portion 210 may be positioned underneath the tee joint portion 160. The drain trap portion 210 may be a drain box 220 with a box like shape. The drain box 220 may have any suitable size, shape, or configuration. The drain trap portion 210 may include a number of trap dividers 230 therein. The trap dividers 230 may extend from the tee joint portion 160 on either side of the inlet 170 and descend into the drain box 220 so as to block substantially the outlets 180, 190 when a volume of water 240 is within the drain box 220. A flow path 250 may extend beneath the trap dividers 230 for the water to flow therethrough. The flow path 250 may have a substantially U-like shape. The flow path 250 may have any suitable size, shape, or configuration. The drain box 220 may be enclosed by a drain cap 260 at a bottom thereof. The box 220 and the drain cap 260 may be fastened and/or sealed in a conventional fashion. Other components and other configurations may be used herein.

The drain box 220 and the drain cap 260 may define a drain access port 270 therein. The drain access port 270 may be enclosed by a drain plug 280. The drain access port 270 and the drain plug 280 may have any suitable size, shape, or configuration. Opening the drain access port 270 allows access to the drain box 220 for easy cleaning and maintenance thereof. Other components and other configurations also may be used herein.

Figure 7:
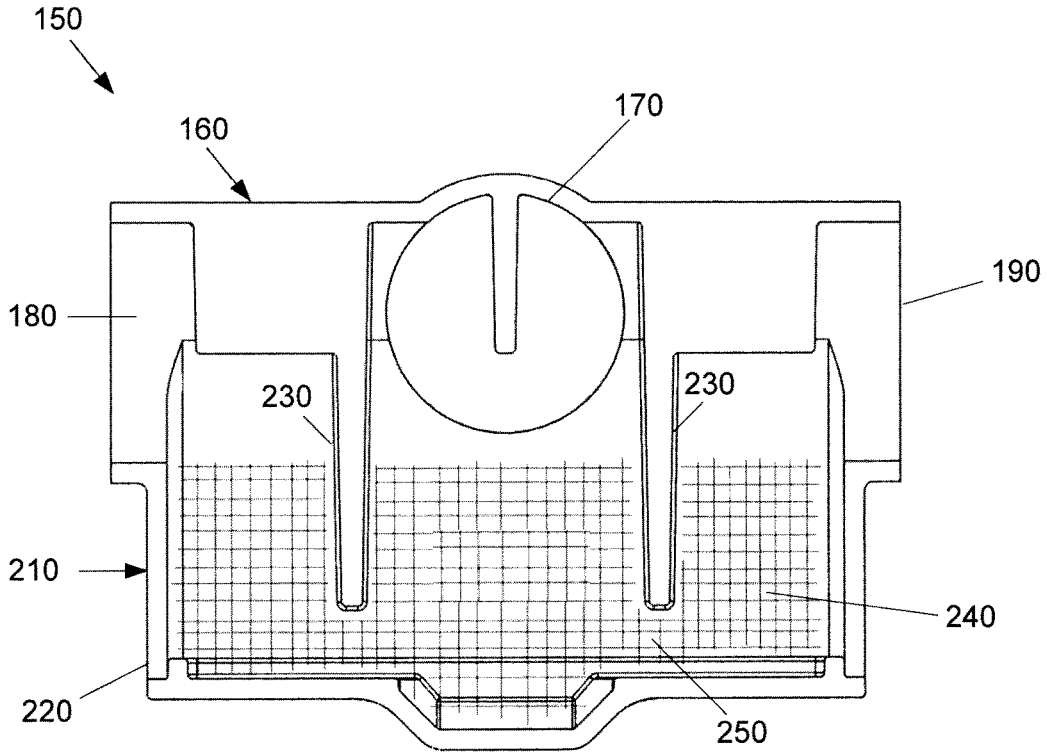
FIG. 7 is a front sectional view of the integrated tee joint-drain trap of FIG. 5 in use.

In use as is shown in FIG. 7, a flow of water 240 may be received in the integrated tee joint-drain trap 150 of the drain system 120 from the tub assembly 110 via the inlet 170 of the tee joint portion 160. The flow of water 240 may be divided by the flow divider 175 and may fall into the drain box 220 of the drain trap portion 210. The water 240 fills the drain box 220 such that the trap dividers 230 prevent the passage of vapors and the like from the drain lines 130 or otherwise. When the volume of the flow of water 240 exceeds the volume of the drain box 220, the flow of water 240 may escape via the outlets 180, 190 into the drain lines 130. When cleaning or other access to the integrated tee joint-drain trap 150 is required, the drain plug 280 may be removed from the drain access port 270 such that the drain box 220 may be cleaned. Other components and other configurations may be used herein.

The drain system 120 with the integrated tee joint-drain trap 150 thus provides adequate flow capacity via a single component with a reduced overall footprint as compared to known systems. Specifically, the integrated tee joint-drain trap 150 limits the intrusion into the customer area while reducing the total number of parts. The drain system 120 thus may reduce the number of plumbing joints so as to reduce leaks, may reduce assembly time, and may result in an overall reduced cost. Further, the integrated tee joint-drain trap 150 limits the passage of vapors and the like. The drain system 120 described herein may be applicable to any product with drains that require a horizontal trap in a limited space.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A refrigerated display case,
comprising:
a tub assembly;
a drain system in communication with the tub assembly;
the drain system comprising an integrated tee joint-drain trap; and
the integrated tee joint-drain trap comprising:
a tee joint for providing flow in three directions, the tee joint having an inlet for receiving a flow of a liquid and a first outlet and a second outlet, the tee joint for fluid communication with a drain line,
a drain trap coupled to and underneath the tee joint, the drain trap formed with an interior volume in fluid communication with the tee joint for receiving liquid and holding at least a apportion of the liquid, and
wherein the drain trap comprises a drain access port for providing access to the interior volume, and a drain plug for mating with the drain access port.

2. The refrigerated display case of claim 1, wherein the drain system wherein the drain line is in fluid communication with the integrated tee joint-drain trap.

3. The refrigerated display case of claim 1, wherein the integrated tee joint-drain trap is positioned along a front of the refrigerated display case.

4. The refrigerated display case of claim 1, wherein the integrated tee joint-drain trap comprises a flow divider positioned proximate the inlet.

5. The refrigerated display case of claim 1, wherein the integrated tee joint-drain trap comprises a pair of trap dividers extending into the interior volume.

6. The refrigerated display case of claim 5, wherein the integrated tee joint-drain trap comprises a flow path in the interior volume and around at least one of the trap dividers.

7. The refrigerated display case of claim 6, wherein the flow path comprises a substantially U shape.

8. The refrigerated display case of claim 1, wherein the drain trap comprises a drain box and wherein a portion of the drain box is formed by a drain cap forming at least a portion of a wall of the drain box.

9. An integrated tee joint-drain trap positioned along a front of a refrigerated display case, the integrated tee joint-drain trap comprising:

an upper tee joint having an inlet for receiving a liquid drained from refrigeration components of the refrigerated display case and a first outlet and a second outlet for communicating liquid to a drain;

a lower drain trap integral with the upper tee joint and in fluid communication with the upper tee joint, the lower drain trap having a drain box and forming a interior volume in the drain box for receiving liquid; and a drain access port formed in the drain box for providing access to the interior volume.

10. The integrated tee joint-drain trap of claim 9, wherein the drain box further comprises a pair of trap dividers projecting into the interior volume to define a flow path therein.

11. The integrated tee joint-drain trap of claim 9, wherein the drain box comprises a drain cap.

12. The integrated tee joint-drain trap of claim 9, further comprising a drain plug for selectively sealing the drain access port.

* * * * *